United States Patent [19]

Ingle et al.

[11] 3,967,529

[45] July 6, 1976

[54] RAIL LAUNCHED MISSILE

[75] Inventors: Colburn L. Ingle; Robert D. Cook; Joseph E. Hibbs, all of Ridgecrest, Calif.

[73] Assignee: The United States of America as represented by the Secretary of the Navy, Washington, D.C.

[22] Filed: June 20, 1974

[21] Appl. No.: 481,092

[52] U.S. Cl. ..... 89/1.819; 89/1.5 G

[51] Int. Cl.[2] ..... F41F 7/00

[58] Field of Search ..... 89/1.5 D, 1.819, 1.8, 89/15 G; 102/34.2

[56] References Cited

UNITED STATES PATENTS

| | | | |
|---|---|---|---|
| 2,852,981 | 9/1958 | Caya | 89/1.5 G |
| 3,115,059 | 12/1963 | Moul | 89/1.819 |
| 3,115,812 | 12/1963 | Eagon et al. | 89/1.819 |
| 3,146,668 | 9/1964 | Wagenseller | 89/1.819 |
| 3,146,670 | 9/1964 | Suydam | 89/1.819 |
| 3,153,980 | 10/1964 | Konglebeck | 89/1.819 |
| 3,186,302 | 6/1965 | Price | 89/1.806 |
| 3,437,285 | 4/1969 | Manfredi et al. | 89/1.819 |

FOREIGN PATENTS OR APPLICATIONS

| | | | |
|---|---|---|---|
| 42,064 | 11/1937 | Netherlands | 89/1.5 G |

*Primary Examiner*—Samuel W. Engle
*Assistant Examiner*—S. A. Cangialosi
*Attorney, Agent, or Firm*—R. S. Sciascia; Roy Miller; Gerald F. Baker

[57] ABSTRACT

A self powered missile is provided with pairs of slotted lugs and curved launching rail cooperating with said lugs. The rail is surmounted by attachment means for fastening to a variety of launch platforms. When the missile is launched, the rail stays with the launcher platform and the lugs retract flush with the skin of the missile.

6 Claims, 1 Drawing Figure

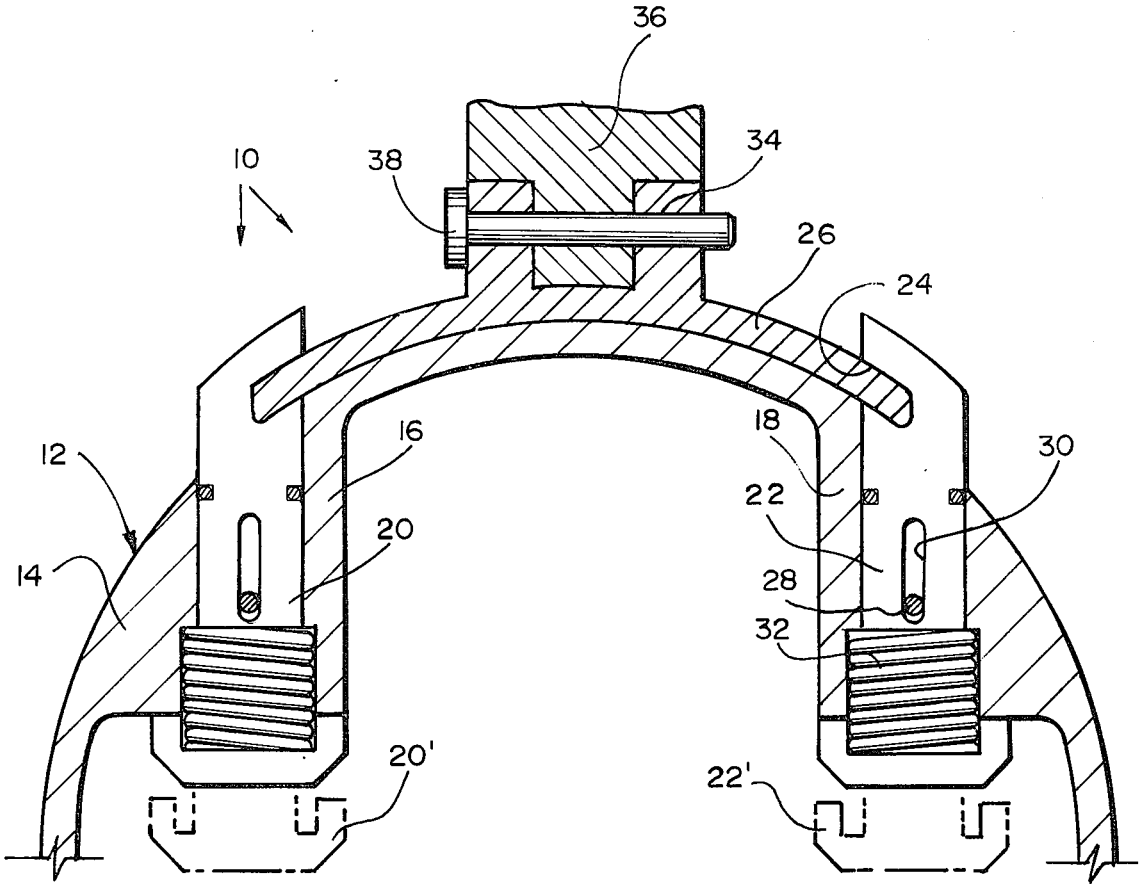
36
34
10
38
26
24
12
16
18
30
22
20
14
28
32
20'
22'

RAIL LAUNCHED MISSILE

CROSS REFERENCE TO RELATED APPLICATIONS

The present invention has objects and purposes similar in some respects to Assignee's U.S. Pat. No. 3,115,059 issued Dec. 24, 1963 to George E. Moul, Jr. and U.S. Pat. No. 3,153,980 issued Oct, 27, 1964 to S. Kongelbeck.

BACKGROUND OF THE INVENTION

A number of missiles have special shoes provided thereon to be launched from special launcher rails provided on the aircraft or other launcher platforms. Practically all of these arrangements require that a different type shoe be provided on the missile for each different launch platform. Attempts have been made, as shown by Assignee's prior patents referenced above, to provide retractable lugs to reduce undesirable aerodynamic drag which would adversely effect missile speed, range and control. These prior art devices, however, were usually rather complicated and in many cases did not achieve a smooth surface when retracted. In the search for a solution to the problem there has arisen the additional problem of providing suitable rails, racks and launching platforms in the various configurations to accommodate the various kinds of rail launch devices.

According to the present invention, there is no need to provide the platform with a particular rail. When a missile is equipped with the launching system according to the present invention it may be attached to and launched from practically any missile launching platform or station with little or no modification.

Each missile is prepared with a plurality of paired retractable lugs having slots on the inboard side and a curved launcher rail is fitted into the notches of the lugs. The launcher rail is contoured to snugly fit the top surface of the missile and carries on its upper surface a longitudinal channel member having a number of holes which make it adaptable to be fitted to a number of existing launcher racks without modifying the racks.

BRIEF DESCRIPTION OF SEVERAL VIEWS OF THE DRAWINGS

The single FIGURE of the drawing is a cross sectional view taken orthogonal to the longitudinal axis of a typical missile constructed in accordance with the present invention.

DESCRIPTION AND OPERATION

The missile and launcher rail combination represented by a cross sectional view through a mounting bulkhead as ultimately furnished to the user is generally designated by the numeral 10 on the drawing. The view shows the missile 12 in cross section through a bulkhead 14 which includes two bosses 16, 18 which are bored to receive launcher lugs 20, 22.

The lugs are slotted at 24 to receive a curved launcher adapter 26. The lugs 22 are held in place in bosses 16, 18 by means of through pins 28 but are allowed a degree of travel determined by the slot 30.

The lugs 20, 22 are urged to a retracted position shown at 20', 22' by means of springs 32.

The launcher which extends along the top surface of the missile adapter rail 26 is provided with a number of holes 34 or other attachment devices (not shown) and the embodiment illustrated is shown fastened to a rack or launching platform 36 by means of pin 38.

During assembly of the missile the lugs 20, 22 are forced outwardly against the action of springs 32 and the adapter 26 is fitted into slot 24. The missile is attached to the launcher station 36 by means of pins 38 through holes 34 and, when the missile is fired, the adapter 26 remains with the launcher platform 36. As soon as the missile motor has achieved sufficient thrust, the lugs 20, 22 will slide off of adapter 26 and the force of springs 32 will immediately retract the lugs flush with the skin of the missile.

According to the foregoing it may be seen that applicants have provided a simple uncomplicated system for use in self powered missile technology to allow a missile to be shipped in condition to be launched from practically any launch platform with little or no modification. It is contemplated, for example, that the adapter 26 be provided with all attachment features necessary for use with the standard aircraft stores racks now in use by U.S. Military forces.

What is claimed is:

1. In a missile system including a missile having an outer skin and a plurality of bulkheads, the combination comprising:

a launcher rail;

at least two bulkheads each including a pair of spaced bosses integral therewith;

each said boss having a bore and receiving therein a launcher rail engaging lug closely fitted for sliding movement within said bore from a first launcher rail engaging position to a second retracted position;

confining means associated with each said lug restricting movement of said lug;

biasing means acting on each said lug in a direction to cause said lug to retract from said first position to said second position within said boss with the outboard end of said lug flush with the skin of said missile at the inward limit of travel;

launcher rail engaging means on each said lug;

said launcher rail being attached to said missile by means of said lugs; and attachment means on said launcher rail for attachment of the launcher rail to an aircraft stores rack or the like.

2. The system of claim 1 further including:

said rail means having a curvature closely approximating the curvature of said missile; and said rail engaging means include curved inwardly facing slots.

3. The system of claim 1 wherein said confining means comprises:

an elongated slot in each said lug;

a pin anchored in each said boss and extending into said slot;

said slot having a lower limit such as to allow extension of said lug from said bore a sufficient distance to engage said rail.

4. The system of claim 3 wherein said pin cooperates with said slot to limit the inward travel of said lugs to a position in which the outer surfaces of said lugs are flush with the surface of said missile.

5. The system of claim 4 further including:

said rail means having a curvature closely approximating the curvature of said missile; and said rail engaging means include curved inwardly facing slots.

6. The system of claim 3 further including:

said rail means having a curvature closely approximating the curvature of said missile; and said rail engaging means include curved inwardly facing slots.

* * * * *